United States Patent [19]

Morita et al.

[11] Patent Number: 4,564,573

[45] Date of Patent: Jan. 14, 1986

[54] ELECTROSTATIC IMAGE FORMING TONER

[75] Inventors: Hideaki Morita; Takahira Kasuya; Goichi Yamakawa; Makoto Tomono, all of Hachioji; Isao Furuta, Suzuka; Minoru Tsuneyoshi, Yokkaichi, all of Japan

[73] Assignees: Konishiroku Photo Industry Co., Ltd.; Japan Synthetic Rubber Co., Ltd., both of Tokyo, Japan

[21] Appl. No.: 634,173

[22] Filed: Jul. 24, 1984

Related U.S. Application Data

[63] Continuation of Ser. No. 356,523, Mar. 9, 1982, abandoned.

[30] Foreign Application Priority Data

Mar. 13, 1981 [JP] Japan ..... 56-35168
Mar. 13, 1981 [JP] Japan ..... 56-35169
Mar. 13, 1981 [JP] Japan ..... 56-35170

[51] Int. Cl.[4] ..... G03G 11/00

[52] U.S. Cl. ..... 430/109; 430/110; 430/124

[58] Field of Search ..... 430/109, 110, 124

[56] References Cited

U.S. PATENT DOCUMENTS 3,965,021 6/1976 Clemens et al. ..... 252/62.1
4,246,332 1/1981 Tanaka et al. ..... 430/110

*Primary Examiner*—John L. Goodrow
*Attorney, Agent, or Firm*—Frishauf, Holtz, Goodman & Woodward

[57] ABSTRACT

An electrostatic image developing toner comprises a binder resin which contains at least 60% by weight of a styrene-butadiene copolymer. The copolymer contains a component A having a molecular weight of at least 100,000 in an amount of at least 20% by weight relative to the binder resin, and a component B having a molecular weight of at least 500,000 in the component A is not more than 15% by weight relative to the binder resin. The toner has adequate flowability and noncoagulation property and is capable of forming a superior visible image in a contact heat fixing system.

10 Claims, No Drawings

ELECTROSTATIC IMAGE FORMING TONER

This application is a continuation of application Ser. No. 356,523, filed Mar. 9, 1982 now abandoned.

The present invention relates to a toner for developing an electrostatic image formed by an electrophotographic method, an electrostatic printing method, an electrostatic recording method or the like, and particularly to an electrostatic image developing toner suitable for a contact heat fixing system such as heat roller fixing.

An electrostatic image is usually developed by a toner composed of fine particles of a binder resin containing a colouring agent, and the toner image thereby obtained will have to be fixed on a support such as a transfer paper. Various fixing methods have been known. However, a contact heat fixing system represented by heat roller fixing is especially preferred, since it is superior in the thermal efficiency to a non-contact fixing system such as oven fixing, and thus permits high speed fixing.

However, in the contact heat fixing system, it is likely that when the toner is brought into contact with the heat roller at the time of fixing, a part thereof deposits on the surface of the roller and then re-transfers to a transfer paper in the subsequent fixing operation, thus giving rise to a so-called offset phenomenon.

In order to prevent such an offset phenomenon, there have been proposed various measures, some of which are in practical use. As practically useful measures, there are a method in which an offset preventive agent such as a silicone oil is applied to the surface of the heat roller, and a method in which a non-offset property is imparted to the toner itself.

The latter method is superior to the former method in that it does not require a mechanism for applying an offset preventive agent whereby the structure of the fixing device can be simplified, and it does not require a supply of the offset preventive agent, whereby the maintenance can easily be made. For these reasons, studies have been made from various angles on toners having a non-offset property, and some of the toners thus developed are in practical use.

However, the conventional non-offset toners are not totally satisfactory with respect to the properties required for practical use.

For instance, in Japanese Patent Publication No. 25654/78, it is disclosed that a toner comprising a styrene-butadiene copolymer resin and a chlorinated paraffin is effective for heat roller fixing. In this toner, however, the chlorinated paraffin contained therein usually has a low molecular weight, and the flowability of the toner powder is low and the coagulation property of the toner is high. Accordingly, the toner tends to coagulate during the storage or in the developing device and thereby to form aggregates. Further, the toner tends to be charged in the developing device or during the supply of the toner into the developing device, whereby the operation such as stirring can not be done smoothly and consequently, it becomes impossible to obtain a good visible image.

Further, the chlorinated paraffin tends to have a negative charge by abrasion, and accordingly, if the electrostatic image to be developed is formed by a negative charge, it can not be used for such development.

As a method of imparting the offset preventive property to the toners, it is also known to incorporate macromolecules in the binder resin constituting the toner. According to this method, when melted for fixing, the toner particles exhibit great aggregation characteristics whereby, the offset phenomenon is extremely effectively prevented.

However, if the binder resin contains macromolecules, the softening point of the toner comes to be substantially high and the temperature for the fixing will have to be raised accordingly, thus offsetting the merit of the contact heat fixing system. Further, the binder resin is thereby strengthened, leading to a drawback that the pulverization which is usually required for the preparation of a toner, becomes difficult.

In order to eliminate these drawbacks, it has been proposed to use, as a binder resin, a resin which contains a low molecular weight component in addition to the high molecular weight component. For instance, Japanese Laid-Open Patent application No. 134625/75 discloses a system in which a styrene-acryl copolymer containing a high molecular weight component and a low molecular weight component, is used as the binder resin, and Japanese Laid-Open application No. 114245/79 discloses a system wherein a resin containing a low molecular weight component composed of a polyester resin, an epoxy resin and a vinyl resin and a high molecular resin component composed of a styrene-butadiene copolymer, is used as the binder resin.

However, the toners composed of these binders do not provide an adequate non-offset property, and there still remain certain problems in their practical application.

Namely, although their non-offset property is much better than the previous toners, the temperature at which the offset phenomenon occurs, is not yet sufficiently high for the practical application. Besides, the actual fixing temperature of the fixing device, i.e. more specifically, the surface temperature of the heat roller, can not always be maintained constantly at the predetermined level because of the non-uniformity of the heat generation of the heater or the replacement of the transfer papers for different sizes, and accordingly, it is quite likely that the heat roller is temporarily or locally brought to a super heated condition. In such a case, it is quite likely that the off-set phenomenon occurs. When the fixing is repeated in a number of times, a small amount of the toner which may be invisible to the eye, will deposit on the surface of the heat roller every time in the fixing operation, and the deposited toner will gradually be accumulated on the surface of the heat roller. As a result, the accumulated toner will be transferred to a visible image thus leading to a stain formation on the visible image.

Further, the toners composed of the above mentioned binder resins tend to have a higher softening point than the toners used for a non-contact fixing system by means of e.g. an oven fixing device, and accordingly, the fixing will have to be conducted at a high temperature, thus leading to an increase of the power consumption, the necessity for a longer period of time for preheating and shortening of the durable life of the fixing device.

In order to avoid such problems, it may be possible to properly select the type, composition or molecular weight of the resin used as the binder resin and to limit the softening point at a lower level. In such a case, however, the glass transition temperature of the resin will inevitably be lowered, and as a result, the coagulation temperature of the toner will be lowered, and the toner tends to coagulate during the storage or in the developing device, thus leading to a serious problem that it becomes inoperable as a toner. From the coagulation point of view, the binder resin for the toner is usually required to have a glass transition temperature of at least 40° C., preferably at least 55° C.

As described in the foregoing, with use of a binder resin composed of a low molecular weight and high molecular weight components, it is possible to impart a non-offset property to the toner to some extent. However, it has been impossible to obtain a toner which has both of the mutually conflicting properties of a low softening temperature and a high glass transition temperature. Thus, it has been impossible to obtain a toner suitable for a contact heat fixing system, which has a good non-coagulation property as well as good fixability including the non-offset property.

Accordingly, a first object of the present invention is to provide an electrostatic image developing toner having adequate properties required for the practical application for contact heat fixing and thus being suitable for the contact heat fixing system.

A second object of the present invention is to provide an electrostatic image developing toner having adequate flowability and a non-coagulation property, and thus being capable of forming a superior visible image A third object of the present invention is to provide an electrostatic image developing toner having a superior triboelectric property and being capable of forming a good visible image.

A fourth object of the present invention is to provide an electrostatic image developing toner, of which the temperature for the occurrence of the offset phenomenon is sufficiently higher than the fixing temperature at which the fixing is adequately accomplished, and which is thus suitable for the practical application to the contact heat fixing system.

A fifth object of the present invention is to provide an electrostatic image developing toner having an adequate non-offset property, being readily pulverized in its production, having a minimal coagulation property so that it does not undergo solidification during the storage or in the developing device, and having adequate flowability.

A sixth object of the present invention is to provide an electrostatic image developing toner whereby good fixing can be accomplished at a relatively low temperature in the contact heat fixing system without formation of the offset phenomenon and the coagulation is suppressed to always form a good visible image.

According to the first aspect of the present invention, the above objects, particularly the first to third objects of the invention, can be accomplished by employing as an essential component of a toner, a binder resin comprising at least 60% by weight of a styrenebutadiene copolymer (hereinafter referred to as "S-B copolymer") which contains a component A having a molecular weight of at least 100,000 in an amount of at least 20% by weight relative to the binder resin, said component A containing a component B having a molecular weight of at least 500,000 in an amount of not more than 15% by weight relative to the binder resin.

According to a second aspect of the present invention, the above objects, particularly the fourth and fifth objects of the invention, can be accomplished by employing as an essential component of the toner, a binder resin comprising at least 60% by weight of the S-B copolymer, in which the ratio ($\overline{M}_w/\overline{M}_n$) of the weight average molecular weight $\overline{M}_w$ to the number average molecular weight $\overline{M}_n$ of the S-B copolymer is at least 20.

According to a third aspect of the present invention, the above objects, particularly the sixth object of the invention, can be accomplished by employing as an essential component of the toner, a binder resin comprising at least 60% by weight of the S-B copolymer composed of a low molecular weight copolymer component (hereinafter referred to as "L-component") and a high molecular weight copolymer component (hereinafter referred to as "H-component"), the bound styrene content in the L-component being greater than that in the H-component, and the total bound styrene content in the S-B copolymer being from 70 to 98% by weight.

In the present invention, the molecular weight including the number average molecular weight $\overline{M}_n$ and the weight average molecular weight $\overline{M}_w$, is obtained by Gel Permeation Chromatography under the following conditions. Namely, with use of Water's 200 Type GPC measuring device (manufactured by Water's Co.), the measurement is conducted in such a manner that while permitting a solvent (i.e. tetrahydrofuran) to flow down at a temperature of 25° C. at a flow rate of 1 ml/min., a tetrahydrofuran solution of sample having a concentration of 0.2 g/dl is introduced into the column in an amount of 4 mg by weight of the sample. As the column to be used here, there may be used a combination of $10^6$-$10^6$-$10^5$-$10^4$.

As the monodisperse polystylene standard samples for establishing a calibration curve, there may be used polystyrenes manufactured by Pressure Chemical Co. and having molecular weights of 1,800,000, 860,000, 411,000, 160,000, 98,200, 51,000, 19,800, 10,000 and 4,000. The insoluble component at the time of the measurement is regarded as a super high molecular weight component having a molecular weight of at least 500,000.

The S-B copolymer used as the essential component of the binder resin in the present invention is obtained by copolymerization of a styrene monomer and butadiene. As the styrene monomer, there may be mentioned styrene, o-methylstyrene, m-methylstyrene, p-methylstyrene, α-methylstyrene, p-ethylstyrene, 2,4-dimethylstyrene, p-n-butylstyrene, p-dodecylstyrene, p-methoxystyrene, p-phenylstyrene, p-chlorostyrene and other styrenes.

According to the first aspect of the invention, the S-B copolymer is required to have a component A having a molecular weight of at least 100,000, and especially the component A must be contained in an amount of at least 20% by weight in the entire binder resin. By virtue of this component A being present as a high molecular weight component, the toner of the present invention exhibits a great aggregation characteristicsic when heated and melted, and as a result, the toner does not deposit on the surface of the heat roller during the fixing operation by means of the heat roller fixing device, whereby the offset phenomenon is prevented.

The component A may contain a component B having a molecular weight of at least 500,000 as a so-called super high molecular weight component. However, the content of the component B must be not more than 15% by weight relative to the entire binder resin. Namely, a macromolecule component formed by cross linking and which can not be detected by e.g. GPC method, may be contained. However, if the component B exceeds 15% by weight, the softening point of the binder resin tends to be higher, whereby the fixing tends to be incomplete.

According to the second aspect of the present invention, the S-B copolymer is required to be the one wherein the ratio ($\overline{M}_w/\overline{M}_n$) of the weight average molecular weight $\overline{M}_w$ thereof to the number average molecular weight $\overline{M}_n$ thereof is at least 20.

With use of a binder resin comprising, as the principal component, the S-B copolymer having the $\overline{M}_w/\overline{M}_n$ ratio of at least 20, it is possible to obtain a toner which has adequate fixability and a great non-offset property, whereby the minimum temperature for the formation of the offset phenomenon becomes sufficiently higher than the fixing temperature at which adequate fixing can be accomplished, and the toner has a good pulverization property and it can readily be produced.

Namely, the S-B copolymer has a relatively great rubber elasticity as compared with other resins, and thus the toner exhibits a great aggregation property when heated and melted during the fixing operation. Accordingly, for instance, the toner does not deposit on the surface of the heat roller and the offset phenomenon can thus be prevented. Besides, this S-B copolymer has a wide molecular weight distribution with the $\overline{M}_w/\overline{M}_n$ ratio being at least 20, whereby adequate fixability, a good pulverization property, non-coagulation property and flowability are obtainable without sacrificing the non-offset property.

An adequate offset property is obtainable if the weight average molecular weight $\overline{M}_w$ of the S-B copolymer is within a range of from 200,000 to 1,500,000. Further, the $\overline{M}_w/\overline{M}_n$ ratio of the S-B copolymer is preferably within a range of from 40 to 90 so as to certainly obtain the above mentioned effectiveness.

The S-B copolymers are widely used and they are also used as binder resins for toners. However, the S-B copolymers differ from each other in their softening temperatures and glass transition temperatures depending upon the molecular weights. These physical properties vary also depending upon the ratio of the styrene monomer unit to the butadiene monomer unit, i.e. bound styrene content of the S-B copolymers. There is a general tendency that the greater the molecular weight becomes, the higher the softening and glass transition temperatures become. However, if the bound styrene content is increased, the glass transition temperature becomes relatively high even when the polymerization degree is relatively low.

In the third aspect of the present invention, this characteristicsic is advantageously utilized. The S-B copolymer is composed of the L-component and the H-component and the styrene content in the former is greater than that in the latter. Usually, the styrene content in the L-component is from 85 to 98%, and the styrene content in the H-component is from 70 to 98%. Within these ranges, the styrene content is selected to be less in the H-component than in the L-component, whereby it is possible to obtain a binder resin having a relatively low softening temperature and a high glass transition temperature.

The total bound styrene content in the entire S-B copolymer is from 70 to 98% by weight. If the total styrene content is less than 70% by weight, the glass transition temperature becomes to be too low to obtain an adequate non-coagulation property. On the other hand, if the styrene content exceeds 98% by weight, the softening temperature of the binder resin becomes to be too high to obtain good fixability.

The L-component is meant for a component having a weight average molecular weight $\overline{M}_w$ of not more than 500,000, and the H-component is meant for a component having a weight average molecular weight $\overline{M}_w$ of at least 800,000.

By virtue of the specified S-B copolymer incorporated as the principal component of the binder resin, as mentioned above, the toner of the present invention is capable of performing good fixing at a relatively low temperature without bringing about the offset phenomenon in the contact heat fixing system and it has an adequate non-coagulation property.

These effects can certainly be obtained especially when the ratio ($\overline{M}_w/\overline{M}_n$) of the weight average molecular weight $\overline{M}_w$ to the number average molecular weight $\overline{M}_n$ is at least 3.5. The number average molecular weight and the weight average molecular weight mentioned here are also determined by the above mentioned GPC method. This $\overline{M}_w/\overline{M}_n$ ratio is usually at most 200.

The above mentioned S-B copolymer may be obtained, for instance, by preparing the low molecular weight S-B copolymer and the high molecular weight S-B copolymer respectively having the predetermined styrene contents, and mixing them by a proper means, e.g. by dissolving them into a common solvent. However, the S-B copolymer to be used in the present invention can especially advantageously be prepared by means of an emulsion polymerization. Namely, the polymerization conditions in the emulsion polymerization are differentiated to obtain a plurality of S-B copolymer emulsions having different polymerization degrees from each other, and after mixing the emulsions, a solidifying agent such as calcium chloride or aluminum sulfate is added thereto to solidify the copolymers, followed by dehydration, to obtain the S-B copolymer. According to this method, a plurality of S-B copolymers can be mixed in their emulsified states, whereby the mixing can readily be done, it is possible to obtain a S-B copolymer having a high uniformity and the operation can be conducted with high efficiency.

In the present invention, the binder resin may be composed solely of the S-B copolymer or may be composed of a mixture of the S-B copolymer with other resins. As mentioned above, however, if the binder resin is composed solely of a high molecular weight component, the softening temperature tends to be high. Accordingly, from the practical point of view, it is preferred to incorporate a low molecular weight component as well. For instance, in a case where the binder resin is composed solely of the S-B copolymer, a component having a molecular weight of not more than 50,000 should preferably be incorporated. Or, in a case where the binder resin is composed of a mixture of the S-B copolymer with other resins, the other resins should preferably be selected from those having a molecular weight of not more than 50,000. By thus incorporating a low molecular weight component into the binder resin, it becomes possible to accomplish adequate fixing at a practically suitable heating temperature, and it becomes possible to readily perform the pulverization which is normally required for the production of a toner. The content of the low molecular weight component is preferably from 40 to 70% by weight relative to the entire binder resin.

As the resins which may be used together with the S-B copolymer, as a component of the binder resin, there may be mentioned, for instance, polystyrene resins, styrene-acryl copolymers, polyester resins, epoxy resins, polyether resins, polyurethane resins, rosinmodified phenol resins, and cellulose resins. Polystyrene resins and styrene-acryl copolymers are particularly preferred as they have good compatibility with the S-B copolymer.

Such a preferred binder resin may be prepared by means of a method wherein the S-B copolymer containing the above mentioned component A in the predetermined amount and a resin (including a low molecular weight S-B copolymer) to constitute the low molecular weight component, are separately prepared and they are dissolved in a common solvent and then taken out, or a method wherein they are synthesized by emulsion polymerization, respectively, and then mixed in the emulsified states, and they are thereafter taken out by means of a coagulation agent such as an acid or a metal salt. Further, in a case where the low molecular weight component is also a S-B copolymer, the polymerization conditions such as a reaction temperature may be changed during the polymerization in the same polymerization reaction system, to obtain a preferred binder resin containing the desired low molecular weight component.

In a case where the binder resin is composed of a mixture of the S-B copolymer with other resins, it is essential that the S-B copolymer constitutes 60% by weight relative to the entire binder resin. If the content of the S-B copolymer is less than 60% by weight, there will be a possibility that the effects of the present invention can not be attained.

The S-B copolymer to be used in the present invention, preferably contains from 70 to 98% by weight, particularly from 85 to 98% by weight, of the styrene component. If a S-B copolymer containing less than 70% by weight of the styrene component is used, the glass transition temperature of the binder resin thereby obtained, will be low, and the toner thereby obtainable will be highly susceptible to coagulation, whereby the effects of the present invention will be diminished. On the other hand, if a S-B copolymer contains more than 98% of the styrene component, the softening point of the binder resin tends to be too high to obtain good fixability.

The binder resins thus prepared may differ depending upon the kinds of the monomers. However, in general, those having a softening point of from about 100° to 170° C. as measured by a ring and ball test, are particularly preferred for the present invention. Further, those having a glass transition temperature of at least 40° C. are preferred. Namely, if the softening temperature is lower than 100° C., such a binder resin tends to be pulverized too far during the pulverization step for the production of a toner, whereby fine powder of the toner will be produced in a substantial amount. The fine toner powder thus produced tends to deposit on the electrostatic image support, thus leading to a so-called toner filming phenomenon. Thus, the fine toner powder causes a stain on the electrostatic image forming support, which in turn causes a stain on the visible image. On the other hand, if the softening temperature is higher than 170° C., a greater heat will be required for the fixing, thus leading to degradation of the fixing efficiency and the pulverization efficiency.

On the other hand, if the glass transition temperature is less than 40° C., the toner tends to coagulate by a cold flow phenomenon and to form aggregates since the storage condition for the toner is usually at a temperature of less than 40° C.

The following method may be employed to obtain the S-B copolymers to be used for the present invention. According to a commonly used polymerization method, a resin having a $\overline{M}_w/\overline{M}_n$ of from 2.0 to 8.0 is obtainable. However, by continuously or stepwise changing the polymerization reaction temperature during the polymerization, or by gradually adding a chain transferring agent to the polymerization system, it is possible to obtain a S-B copolymer having a $\overline{M}_w/\overline{M}_n$ ratio of at least 20.

Further, it is possible to employ a method in which a plurality of S-B copolymers having different polymerization degrees are prepared, and they are then mixed together. According to this method, by properly selecting the mixing ratio of a S-B copolymer having a low molecular weight to a S-B copolymer having a high molecular weight, it is possible to readily obtain a S-B copolymer having a great $\overline{M}_w/\overline{M}_n$ ratio, i.e. a wide molecular weight distribution, and thus being suitable for the present invention.

The toners of the present invention are prepared by incorporating into particles of the above described binder resin, other toner components such as colouring agents such as pigments or dyes, and, if required, other additives such as an agent for controlling the electrostatic polarity. If a magnetic toner is desired, a magnetic fine powder is incorporated by dispersing it in the toner. The particle size of the toner particles is usually from 1 to 50 microns, preferably from 3 to 20 microns.

As specific examples of the above mentioned colouring agents, there may be mentioned, carbon black, Nigrosine dye (C.I. No. 50415 B), Aniline Blue (C.I. No. 50405), Chalcoil Blue (C.I. No. azoec Blue 3), Chrome Yellow (C.I. No. 14090), Ultramarine Blue (C.I. No. 77103), Dupont Oil Red (C.I. No. 26105), Quinoline Yellow (C.I. No. 47005), Methylene Blue Chloride (C.I. No. 52015), Phthalocianine Blue (C.I. No. 74160), Malachite Green Oxalate (C.I. No. 42000), Lamp Black (C.I. No. 77266) and Rose Bengale (C.I. No. 45435), and their mixtures. These colouring agents are incorporated in an amount sufficient to form a visible image having an adequate density by development. They are usually incorporated in an amount of from 1 to 20 parts by weight relative to 100 parts by weight of the binder resin.

As specific examples of the magnetic substance to be used for the preparation of magnetic toners, there may be mentioned metals composed of ferromagnetic elements such as iron, cobalt and nickel, including ferrite and magnetite, or alloys or compounds containing such metals, or alloys which do not contain a ferromagnetic element but which can be made to have a ferromagnetic property by a proper treatment such as heat treatment, for instance, alloys of the type called Heusler's alloys and containing manganese and copper, such as manganesecopper-aluminum, or manganese-copper-tin, or chromium dioxide or the like. The content of the fine powder of such magnetic substances is usually from 20 to 70% by weight, preferably from 40 to 70% by weight, relative to the entire toner.

The toners of the present invention may be prepared by a conventional method. Namely, a colouring agent, a magnetic fine powder, or other additives are mixed to the above binder resin, for instance by subjecting them to dispersing treatment for 24 hours by means of a ball mill, then the mixture is kneaded by heat rolls and thereafter cooled, and the aggregates thereby obtained are pulverized to obtain particles having a desired particle size, and thus to obtain a toner of the present invention.

As described in the foregoing, with a binder resin comprising the specific S-B copolymer as its principal component, the toners of the present invention have adequate developability and fixability required for the practical application for a contact heat fixing system, and they are superior in the non-offset property and have adequate flowability and a non-coagulation property as well as a superior triboelectric characteristicsic. Thus, they are capable of always forming good visible images.

Now, the present invention will be described with reference to Examples. It should be understood, however, that the present invention is not limited to these Examples. The term "part(s)" is meant for "part(s) by weight".

EXAMPLE 1

| Preparation of a binder resin | |
|---|---|
| Dispering medium | |
| Water | 180 parts |
| Monomers | |
| Butadiene | 10 parts |
| Styrene | 90 parts |
| Divinylbenzene | 0.5 part |
| Emulsifiers | |
| Potassium salts of fatty acids | 2.2 parts |
| Potassium salts of disproportionated rhodinic acids | 2.2 parts |
| Potassium phosphate | 0.4 part |
| Polymerization initiator system | |
| Ferrous sulfate | 0.005 part |
| Paramentane hydroperoxide | 0.02 part |
| t-Dodecylmercaptan | 0.5 part |

The materials of the above formulation were introduced into an autoclave having a capacity of 20 l purged with a nitrogen gas, and a polymerization reaction was carried out at a temperature of 5° C. When the conversion reached 70%, 0.2 part of a polymerization terminator, N,N'-diethylhydroxyamine, was added to terminate the reaction. The residual monomer of the latex was eliminated, and, to the latex thereby obtained, there was added one part of a stabilizer, and then calcium chloride as a coagulation agent was introduced to solidify the polymer. The solidified polymer was dehydrated and dried, whereby a resin was obtained. This resin is designated as "Resin 1".

This Resin 1 contained 41% by weight of the component A having a molecular weight of at least 100,000, and 3% by weight of a component B having a molecular weight of at least 500,000 being contained in this component A.

Preparation of a Toner

The above Resin 1 was used as a binder resin, and 100 parts of the Resin 1 and 5 parts of carbon black as a colouring agent were mixed, and subjected to dispersion, kneading, pulverization and classification in accordance with usual methods, whereby a toner of the present invention having an average particle size of 15 microns was obtained. This toner is designated as "Sample 1".

EXAMPLE 2

Preparation of a Binder Resin

The Resin 1 obtained by the preparation of a binder resin of Example 1 and a styrene-acryl copolymer "Highmer SBM 73" (manufactured by Sanyo Kasei Co.) were dissolved in a solvent, methyl ethyl ketone, in a weight ratio of 7:3, whereby a mixed resin composed of the Resin 1 and the styrene-acryl copolymer was obtained. This mixed resin is designated as "Resin 2".

Preparation of a Toner

A toner of the present invention having an average particle size of 15 microns was obtained in a manner similar to the preparation of a toner in Example 1 except that the above Resin 2 was used as the binder resin. This toner is designated as "Sample 2".

EXAMPLE 3

Preparation of a Binder Resin

A latex A composed of a low molecular weight resin was obtained in a manner similar to Example 1 except that in the formulation for the preparation of a binder resin in Example 1, 0.16 part of divinylbenzene and 1.3 parts of t-dodecylmercaptan were used and the polymerization reaction temperature was set at 5° C.

On the other hand, a latex B composed of a high molecular weight resin was obtained in a manner similar to Example 1 except that in the formulation for the preparation of a binder resin in Example 1, 0.16 part of divinylbenzene and 0.4 part of t-dodecylmercaptan were used and the polymerization reaction temperature was set at 5° C.

The above latex A and latex B were mixed in a solid content ratio of 2:1, and the mixed latex was treated in the same manner as in Example 1, whereby a resin was obtained. This resin is designated as "Resin 3".

This Resin 3 contained 28% by weight of the component A, 10% by weight of the component B and 57% by weight of a low molecular weight component having a molecular weight of not more than 50,000.

Preparation of a Toner

A toner of the present invention having an average particle size of 15 microns was obtained in a manner similar to the preparation of a toner in Example 1 except that the above Resin 3 was used as the binder resin. The toner is designated as "Sample 3".

COMPARATIVE EXAMPLE 1

Preparation of a Binder Resin

A resin was obtained in a manner similar to Example 1 except that in the formulation for the preparation of a binder resin in Example 1, 0.16 part of divinylbenzene and 1.3 parts of t-dodecylmercaptan were used and the polymerization reaction temperature was set at 5° C. This resin is designated as "Comparative Resin 1".

This Comparative Resin 1 contained 19% by weight of the component A and 3% by weight of the component B.

Preparation of a Toner

A comparative toner having an average particle size of 15 microns was obtained in a manner similar to the preparation of a toner in Example 1, except that the above Comparative Resin 1 was used as the binder resin. This comparative toner is designated as "Comparative Sample 1".

COMPARATIVE EXAMPLE 2

In a manner similar to Example 1 except that in the formulation for the preparation of a binder resin in Example 1, 1.0 part of divinylbenzene and 0.5 part of t-dodecylmercaptan were used, there was obtained a resin composed of a S-B copolymer comprising 70% by weight of a S-B copolymer component having a molecular weight of at least 100,000 and 30% by weight of a S-B copolymer component having a molecular weight of at least 500,000.

With use of this resin, a comparative toner having an average particle size of 15 microns was prepared in a manner similar to Example 1. This comparative toner is designated as "Comparative Sample 2".

EXAMPLE 4

The Resin 1 obtained by the preparation of a binder resin in Example 1 was used as the binder resin. With use of 50 parts of the Resin 1, 50 parts of fine powder of tri-iron tetraoxide and 3 parts of carbon black, a magnetic toner of the present invention having an average particle size of 15 microns was obtained by a usual method. This magnetic toner is designated as "Sample 4".

TEST EXAMPLE

With respect to each of the Samples 1 to 4 and the Comparative Samples 1 and 2 obtained by Examples 1 to 4 and Comparative Examples 1 and 2, respectively, the minimum fixing temperature for the generation of the offset phenomenon was investigated. Namely, 5 parts of each of the Samples 1 to 3 and the Comparative Samples 1 and 2 were mixed with 95 parts of an iron carrier to prepare a total of 5 different kinds of developing agents; with use of each developing agent, a toner image was formed on a transfer paper by means of an electrophotographic copying machine "U-Bix V" (manufactured by Konishiroku Photo Ind. Co., Ltd.); the toner image was fixed by a heat roller fixing device set at a fixing temperature; and then a white transfer paper was fed to the fixing device operated under the same condition to see whether or not a toner stain appeared on the transfer paper, thereby determining whether or not the offset phenomenon occurred. This operation was repeated at various fixing temperatures of the fixing device. The fixing device was provided with a heat roller having its surface coated with Teflon (i.e. polytetrafluoroethylene manufactured by Dupont Co.) and a pressure roller having its surface coated with a silicone rubber "KR-1300 RTV" (manufactured by Shin-etsu Chemical Co., Ltd.). The minimum temperature for the generation of the offset phenomenon was thereby determined.

With respect to the Sample 4, the minimum temperature for the generation of the offset phenomenon was determined in a manner similar to the above, except that the toner image thereof was formed by means of an electrophotographic copying machine "U-Bix T" (manufactured by Konishiroku Photo Ind. Co., Ltd.).

The results thereby obtained are as shown in the following Table.

TABLE 1

| Toners | Offset generation temperatures (°C.) |
|---|---|
| Sample 1 | 220 |
| Sample 2 | 210 |
| Sample 3 | 215 |
| Comparative Sample 1 | 160 |
| Comparative Sample 2 | Inferior fixing |
| Sample 4 | 230 |

The Samples 1 to 4 according to the present invention had adequate flowability and a non-coagulation property as well as a good triboelectric characteristicsic. In a continuous copying test, each toner presented a good copy image even when the number of copying operations exceeded 5000 times.

Whereas, in the case of the Comparative Sample 1, the offset phenomenon occurred from the initial stage, and the image was thereby stained. Consequently, no good image was thereby obtainable. Further, in the case of the Comparative Sample 2, the toner had a low softening temperature, and consequently, the fixing thereby obtainable was incomplete.

EXAMPLE 5

| Preparation of a binder resin | |
|---|---|
| Dispersing medium | |
| Water | 180 parts |
| Monomers | |
| Butadiene | 10 parts |
| Styrene | 88 parts |
| Divinylbenzene | 2 parts |
| Emulsifiers | |
| Potassium salts of fatty acids | 2.2 parts |
| Potassium salts of disproportionated rhodinic acids | 2.2 parts |
| Potassium phosphate | 0.4 part |
| Polymerization initiator system | |
| Ferrous sulfate | 0.0005 part |
| Paramentane hydroperoxide | 0.02 part |
| t-Dodecylmercaptan | 2.1 parts |

The materials of the above formulation were introduced into an autoclave having a capacity of 20 l purged with a nitrogen gas, and a polymerization reaction was carried out at a temperature of 5° C. When the conversion reached 70%, 0.2 part of a polymerization terminator, N,N'-diethylhydroxyamine, was added to terminate the reaction. To the latex thereby obtained, there was added one part of a stabilizer, and then potassium chloride as a solidifying agent was introduced to solidify the polymer. The solidified polymer was dehydrated and dried to obtain a resin. This resin is designated as "Resin 5".

This Resin 5 had a weight average molecular weight $\overline{M}_w$ of 1,500,000, a number average molecular weight $\overline{M}_n$ of 17,000 and a $\overline{M}_w/\overline{M}_n$ ratio of 89.

Preparation of a toner

The above Resin 5 was used as a binder resin, and 100 parts of the Resin 5 and 5 parts of carbon black as a colouring agent were mixed, and subjected to dispersion, kneading, pulverization and classification in accordance with conventional methods, whereupon a toner of the present invention having an average particle size of 15 microns was obtained. This toner is designated as "Sample 5".

EXAMPLE 6

Preparation of a binder resin

The Resin 5 obtained by the preparation of a binder resin of Example 5 and a polyester resin "ATLAC 382 A" (manufactured by Kao Atlas Co.) were mixed in a weight ratio of 7:3 and melted, whereby a mixed resin composed of the Resin 5 and the polyester resin was obtained. This resin is designated as "Resin 6". This Resin 6 contained about 69% by weight of the S-B copolymer.

Preparation of a toner

In a manner similar to the preparation of a toner in Example 5 except that the above Resin 6 was used as the binder resin, there was obtained a toner of the present invention having an average particle size of 15 microns. This toner is designated as "Sample 6".

EXAMPLE 7

Preparation of a binder resin

In a manner similar to Example 5 except that in the formulation for the preparation of a binder resin in Example 5, 90 parts of styrene, 0.16 part of divinylbenzene and 1.3 parts of t-dodecylmercaptan were used and the polymerization reaction temperature was set at 5° C., there was obtained a latex A composed of a low molecular weight resin.

On the other hand, in a manner similar to Example 5 except that in the formulation for the preparation of a binder resin in Example 5, 90 parts of styrene, 0.16 part of divinylbenzene, and 0.4 part of t-dodecylmercaptan were used and the polymerization reaction temperature was set at 5° C., there was obtained a latex B composed of a high molecular weight resin.

The above latex A and latex B were mixed in a solid content ratio of 1:2, and the mixed latex was treated in a manner similar to Example 5, whereby a resin was obtained. This resin is designated as "Resin 7".

This Resin 7 had $\overline{M}_w=620{,}000$, $\overline{M}_n=25{,}000$ and $\overline{M}_w/\overline{M}_n=25$.

Preparation of a toner

In a manner similar to the preparation of a toner in Example 5 except that the above Resin 7 was used as the binder resin, there was obtained a toner of the present invention having an average particle size of 15 microns. This toner is designated as "Sample 7".

EXAMPLE 8

Preparation of a binder resin

In a manner similar to Example 5 except that in the formulation for the preparation of a binder resin in Example 5, 89.5 parts of styrene, 0.5 part of divinylbenzene, and 1.1 parts of t-dodecylmercaptan were used and the polymerization reaction temperature was set at 5° C., there was obtained a latex C composed of a high molecular weight resin.

On the other hand, in a manner similar to Example 5 except that in the formulation for the preparation of a binder resin in Example 5, 98 parts of styrene, 2 parts of butadiene, 0.16 part of divinylbenzene and 3 parts of t-dodecylmercaptan were used and the polymerization reaction temperature was set at 5° C., there was obtained a latex D composed of a low molecular weight resin.

The above latex C and latex D were mixed in a solid content ratio of 2:3, and the mixed latex was treated in a manner similar to Example 5, whereby a resin was obtained. This resin is designated as "Resin 8". This Resin 8 had $\overline{M}_w=600{,}000$, $\overline{M}_n=12{,}000$ and $\overline{M}_w/\overline{M}_n=50$.

Preparation of a toner

In a manner similar to the preparation of a toner in Example 5 except that the above Resin 8 was used as the binder resin, there was obtained a toner of the present invention having an average particle size of 15 microns. This toner is designated as "Sample 8".

COMPARATIVE EXAMPLE 3

Preparation of a binder resin

A resin was obtained in a manner similar to Example 5 except that in the formulation for the preparation of a binder resin in Example 5, 90 parts of styrene, 0.16 part of divinylbenzene, and 1.3 part of t-dodecylmercaptan were used and the polymerization reaction temperature was set at 5° C. This resin is designated as "Comparative Resin 3".

This Comparative Resin 3 had $\overline{M}_w=70{,}000$, $\overline{M}_n=17{,}000$ and $\overline{M}_w/\overline{M}_n=4.1$.

Preparation of a toner

A comparative toner having an average particle size of 15 microns was obtained in a manner similar to the preparation of a toner in Example 5 except that the above Comparative Resin 3 was used as the binder resin. This comparative toner is designated as "Comparative Sample 3".

COMPARATIVE EXAMPLE 4

Preparation of a binder resin

A resin was obtained in a manner similar to Example 5 except that in the formulation for the preparation of a binder resin in Example 5, 90 parts of styrene, 0 part of divinylbenzene and 0.5 part of t-dodecylmarcaptan, and the polymerization reaction temperature was set at 5° C. This resin is designated as "Comparative Resin 4".

This Comparative Resin 4 had $\overline{M}_w=110{,}000$, $\overline{M}_n=55{,}000$ and $\overline{M}_w/\overline{M}_n=2$.

Preparation of a toner

A comparative toner having an average particle size of 15 microns was obtained in a manner similar to the preparation of a toner in Example 5 except that the above Comparative Resin 4 was used as the binder resin. This comparative toner is designated as "Comparative Sample 4".

EXAMPLE 9

The Resin 5 obtained by the preparation of a binder resin in Example 5 was used as the binder resin. With use of 50 parts of the Resin 5, 50 parts of fine powder of tri-iron tetraoxide and 3 parts of carbon black, there was obtained a magnetic toner of the present invention having an average particle size of 15 microns, by a usual method. The magnetic toner is designated as "Sample 9".

TEST EXAMPLE

With respect to each of the Sample 5 to 9 and the Comparative Samples 3 and 4 obtained by Examples 5 to 9 and Comparative Examples 3 and 4, respectively, the temperature for the generation of the offset phenomenon, the minimum fixing temperature and the pulverization property were investigated.

With respect to the Samples 5 to 8 and the Comparative Samples 3 and 4, the temperature for the generation of the offset phenomenon was determined in such a manner that 5 parts of each sample was mixed with 95 parts of an iron powder carrier to prepare a total of six different kinds of developing agents; with use of each developing agent, a toner image was formed on a transfer paper by means of an electrophotographic copying machine "U-Bix V" (manufactured by Konishiroku Photo Ind. Co., Ltd.); the toner image was fixed by a heat roller fixing device set for a fixing temperature; thereafter, a white transfer paper was fed to the fixing device operated under the same condition to see whether or not a toner stain appeared on the transfer paper, thereby determining whether or not the offset phenomenon occurred; and this operation was repeated at various fixing temperatures of the fixing device to determine the minimum temperature for the generation of the offset phenomenon. The surface layer of the heat roller of the fixing device was composed of Teflon.

With respect to the Sample 9, the minimum temperature for the generation of the offset phenomenon was determined in a manner similar to the above except that the toner image thereof was formed by means of an electrophotographic copying machine "U-Bix T" (manufactured by Konishiroku Photo Ind. Co., Ltd.).

The determination of the minimum fixing temperature was carried out in such a manner that a toner image was formed in the same manner as in the above determination of the temperature of the generation of the offset phenomenon; and the operation for fixing the toner was repeated at various temperatures of the fixing device to obtain the minimum temperature at which adequate fixing was accomplished.

The determination of the pulverization property was carried out in such a manner that aggregates of each of the Samples and Comparative Samples prior to the pulverization in the preparation, were roughly pulverized; the roughly pulverized material was finely pulverized by a jet pulverizer under the conditions of a pulverizing pressure of 6.0 kg/cm$^2$ and a feeding rate of 100 g/min; and an average particle size of the obtained product was measured.

The results thereby obtained are shown in the following Table together with the temperature ranges within which the fixing is operable. This fixing operable temperature range is a temperature range within which adequate fixing can be done without generation of the offset phenomenon, and thus represents a difference between the temperature for the generation of the offset phenomenon and the minimum fixing temperature.

TABLE 2

| | Offset generation temperature (°C.) | Minimum fixing temperature (°C.) | Fixing operable temperature ranges (degrees) | Pulverization properties (microns) |
|---|---|---|---|---|
| Sample 5 | 225 | 140 | 85 | 17 |
| Sample 6 | 210 | 135 | 75 | 14 |
| Sample 7 | 210 | 135 | 75 | 11 |
| Sample 8 | 215 | 130 | 85 | 13 |
| Comparative Sample 3 | 160 | 120 | 25 | 11 |
| Comparative Sample 4 | 220 | 180 | 45 | 30 |

TABLE 2-continued

| | Offset generation temperature (°C.) | Minimum fixing temperature (°C.) | Fixing operable temperature ranges (degrees) | Pulverization properties (microns) |
|---|---|---|---|---|
| Sample 9 | 235 | 150 | 85 | 15 |

It is apparent from the results shown in Table 2 that each of Samples 5 to 9 of the present invention has a high temperature for the generation of the offset phenomenon, a low minimum fixing temperature, a wide fixing operable temperature range and a superior pulverization property. Whereas, in the case of the Comparative Samples 3 and 4 using binder resins composed of S-B copolymers having smaller $\overline{M}_w/\overline{M}_n$ ratios, the former comprises a binder resin having a small molecular weight and has a low temperature for the generation of the offset phenomenon, and the latter comprises a binder resin having a great molecular weight and has an inferior pulverization property, and thus they are not suitable for practical application.

Further, the Samples 5 to 9 of the present invention have adequate flowability and a non-coagulation property as well as a good triboelectric characteristic. In a continuous copying test, each toner presented a good copy image even when the number of copying operations exceeded 5,000 times.

EXAMPLE 10

| Preparation of a binder resin | |
|---|---|
| Dispersing medium | |
| Water | 180 parts |
| Monomers | |
| Butadiene | 10 parts |
| Styrene | 90 parts |
| Divinylbenzene | 0.5 part |
| Emulsifiers | |
| Potassium salts of fatty acids | 2.2 parts |
| Potassium salts of disproportionated rhodinic acids | 2.2 parts |
| Potassium phosphate | 0.4 part |
| Polymerization initiator system | |
| Ferrous sulfate | 0.005 part |
| Paramentane hydroperoxide | 0.02 part |
| t-Dodecylmercaptan | 1.0 part |

The materials of the above formulation were introduced into an autoclave having a capacity of 20 l purged with a nitrogen gas, and a polymerization reaction was carried out at a temperature of 5° C. When the conversion reached 70%, 0.2 part of a polymerization terminator, N,N'-diethylhydroxyamine, was added to terminate the reaction, whereby a latex A was obtained. This latex A, when subjected to a solidification treatment, gave a S-B copolymer having a weight average molecular weight $\overline{M}_w$ of 3,000,000 and a number average molecular weight $\overline{M}_n$ of 30,000.

On the other hand, a latex B was obtained in a manner similar to the above except that in the formulation for the preparation of the latex A, 98 parts of styrene, 2 parts of butadiene, 0.16 part of divinylbenzene and 3.5 parts of t-dodecylmercaptan were used and the polymerization reaction temperature was set at 5° C. This latex B, when subjected to a solidification treatment, gave a S-B copolymer resin having a weight average molecular weight $\overline{M}_w$ of 10,000, and a number average molecular weight $\overline{M}_n$ of 6,000.

The above latex A and latex B were mixed in a solid content ratio of 2:3. To the mixed latex thereby obtained, a stabilizer was added, and then a solidification agent, calcium chloride, was introduced to solidify the polymer. The solidified polymer was dehydrated and dried, whereby a S-B copolymer comprising the H-component composed of the latex A and the L-component composed of the latex B was obtained. This copolymer is designated as "Resin 10".

This Resin 10 contained about 95% by weight of the styrene component, wherein the styrene contents in the H-component and L-component are 90% by weight and 98% by weight, respectively, and had $\overline{M}_w$=730,000, $\overline{M}_n$=16,000, $\overline{M}_w/\overline{M}_n$=about 46 and a glass transition temperature of 62° C.

Preparation of a toner

The above Resin 10 was used as the binder resin, and 100 parts of the Resin 10 and 5 parts of carbon black as a colouring agent were mixed and subjected to dispersing, kneading, pulverization and classification in accordance with the conventional methods, whereby a toner of the present invention having an average particle size of 15 microns was obtained. This toner is designated as "Sample 10".

EXAMPLE 11

Preparations of a biner resin

A latex C was obtained in a manner similar to Example 10 except that in the formulation for the preparation of the latex A in Example 10, 90 parts of styrene, 10 parts of butadiene, 0.16 part of divinylbenzene and 0.4 part of t-dodecylmercaptan were used and the polymerization reaction temperature was set at 5° C. This latex C, when subjected to a solidification treatment, gave a S-B copolymer resin having $\overline{M}_w$=1,000,000 and $\overline{M}_n$=30,000.

On the other hand, a latex D was obtained in a manner similar to Example 10, except that in the formulation for the preparation of the latex A in Example 10, 95 parts of styrene, 5 parts of butadiene, 0.16 part of divinylbenzene and 2.3 parts of t-dodecylmercaptan were used and the polymerization reaction temperature was set at 5° C. This latex D, when subjected to a solidification treatment, gave a S-B copolymer resin having a weight average molecular weight $\overline{M}_w$ of 20,000 and a number average molecular weight $\overline{M}_n$ of 8,000.

The above latex C and latex D were mixed in a solid content ratio of 1:2. To the mixed latex thereby obtained, a stabilizer was added, and then a solidifying agent, calcium chloride, was introduced to solidify the polymer. The solidified polymer was dehydrated and dried, whereby a S-B copolymer comprising the H-component composed of the latex C and the L-component composed of the latex D was obtained. This copolymer is designated as "Resin 11".

This Resin 11 contained about 93% by weight of the styrene component in which the styrene contents in the H-component and the L-component were 90% by weight and 95% by weight, respectively, and had $\overline{M}_w$=350,000, $\overline{M}_n$=15,000, $\overline{M}_w\overline{M}_n$=about 23, and a glass transition temperature of 57° C.

Preparation of a toner

A toner of the present invention having an average particle size of 15 microns was obtained in a manner similar to the preparation of a toner in Example 10 except that the above Resin 11 was used as the binder resin. This toner is designated as "Sample 11".

COMPARATIVE EXAMPLE 5

Preparation of a binder resin

A latex E was obtained in a manner similar to Example 10 except that in the formulation for the preparation of the latex A in Example 10, 90 parts of styrene, 10 parts of butadiene, 0.16 part of divinylbenzene and 0.4 part of t-dodecylmercaptan were used and the polymerization reaction temperature was set at 5° C. This latex E, when subjected to a solidification treatment, gave a S-B copolymer resin having $\overline{M}_w$=1,000,000 and $\overline{M}_n$=30,000.

On the other hand, a latex F was obtained in a manner similar to Example 10 except that in the formulation for the preparation of the latex A, 90 parts of styrene, 10 parts of butadiene, 0.16 part of divinylbenzene and 1.3 parts of t-dodecylmercaptan were used and the polymerization reaction temperature was set at 5° C. This latex F, when subjected to a solidification treatment, gave a S-B copolymer resin having a weight average molecular weight $\overline{M}_w$ of 70,000, and a number average molecular weight $\overline{M}_n$ of 20,000.

The above latex E and latex F were mixed in a solid content ratio of 1:2. To the mixed latex thereby obtained, a stabilizer was added, and then a solidifying agent, calcium chloride, was introduced to solidify the polymer. The solidified polymer was dehydrated and dried, whereby a S-B copolymer comprising the H-component composed of the latex E and the L-component composed of the latex F was obtained. This copolymer is designated as "Comparative Resin 5".

This Comparative Resin 5 contained 90% by weight of the styrene component, in which the styrene contents in the H-component and the L-component were 90% by weight and 90% by weight, respectively, and had $\overline{M}_w$=350,000, $\overline{M}_n$=20,000, $\overline{M}_w/\overline{M}_n$=17.5, and a glass transition temperature of 52° C.

Preparation of a toner

A comparative toner having an average particle size of 15 microns was obtained in a manner similar to the preparation of a toner in Example 10 except that the above Comparative Resin 5 was used as the binder resin. The comparative toner is designated as "Comparative Sample 5".

COMPARATIVE EXAMPLE 6

Preparation of a binder resin

A latex G was obtained in a manner similar to Example 10, except that in the formulation for the preparation of the latex A in Example 10, 97 parts of styrene, 3 parts of butadiene, 0.5 part of divinylbenzene and 1.0 part of t-dodecylmercaptan were used and the polymerization reaction temperature was set at 5° C. This latex G, when subjected to a solidification treatment, gave a S-B copolymer resin having $\overline{M}_w$=2,900,000 and $\overline{M}$=27,000.

On the other hand, a latex H was obtained in a manner similar to Example 10 except that in the formulation for the preparation of the latex A, 97 parts of styrene, 3 parts of butadiene 0.16 part of divinylbenzene and 1.3 parts of t-dodecylmercaptan were used and the polymerization reaction temperature was set at 5° C. This latex H, when subjected to a solidification treatment, gave a S-B copolymer resin having a weight average molecular weight $\overline{M}_w$ of 40,000 and a number average molecular weight $\overline{M}_n$ of 15,000.

The above latex G and latex H were mixed in a solid content ratio of 1:2. To the mixed latex thereby obtained, a stabilizer was added and then a solidifying agent, calcium chloride, was introduced to solidify the polymer. The solidified polymer was dehydrated and dried, whereby a S-B copolymer comprising the H-component composed of the latex G and the L-component composed of the latex H was obtained. This copolymer is designated as "Comparative Resin 6".

This Comparative Resin 6 contained 97% by weight of the styrene component, in which the styrene contents in the H-component and the L-component were 97% by weight and 97% by weight, respectively, and had $\overline{M}_w$=1,000,000, $\overline{M}_n$=22,000, $\overline{M}_w/\overline{M}_n$ about 45.5 and a glass transition temperature of 71° C.

Preparation of a toner

A comparative toner having an average particle size of 15 microns was obtained in a manner similar to the preparation of a toner in Example 10 except that the above Comparative Resin 6 was used as the binder resin.

COMPARATIVE EXAMPLE 7

Preparation of a binder resin

A latex M was obtained in a manner similar to Example 10 except that in the formulation for the preparation of the latex A in Example 10, 65 parts of styrene and 35 parts of butadiene were used. This latex M, when subjected to a solidification treatment, gave a S-B copolymer resin having $\overline{M}_w$=3,900,000, and $\overline{M}_n$=50,000.

On the other hand, a latex N was obtained in a manner similar to Example 10 except that in the formulation for the preparation of the latex A, 70 parts of styrene, 30 parts of butadiene, 0.16 part of divinylbenzene and 3.5 parts of t-dodecylmercaptan were used. This latex N, when subjected to a solidification treatment, gave a S-B copolymer resin having $\overline{M}_w$=9,000 and $\overline{M}_n$=6,500.

The above latex M and latex N were mixed in a solid content ratio of 2:3. To the mixed latex thereby obtained, a stabilizer was added and then a solidifying agent, calcium chloride, was introduced to solidify the polymer. The solidified polymer was dehydrated and dried, whereby a S-B copolymer comprising the H-component composed of the latex M and the L-component composed of the latex N was obtained. This copolymer is designated as "Comparative Resin 7".

This Comparative Resin 7 contained 68% by weight of the styrene component, in which the styrene contents in the H-component and the L-component were 65% by weight and 70% by weight, respectively, and had $\overline{M}_w$=650,000, $\overline{M}_n$=13,000, $\overline{M}_w/\overline{M}_n$=50, and a glass transition temperature of 5° C.

Preparation of a toner

A comparative toner having an average particle size of 15 microns was obtained in a manner similar to the preparation of a toner in Example 10 except that the above Comparative Resin 7 was used as the binder resin. This comparative toner is designated as "Comparative Sample 7".

COMPARATIVE EXAMPLE 8

Preparation of a binder resin

The latex F of the Comparative Example 5 and the latex G of the Comparative Example 6 were mixed in a solid content ratio of 2:1. To the mixed latex thereby obtained, a stabilizer was added, and then a solidifying agent, calcium chloride, was introduced to solidify the polymer. The solidified polymer was dehydrated and dried, whereby a S-B copolymer comprising the L-component composed of the latex F and the H-component composed of the latex G was obtained. The copolymer is designated as "Comparative Resin 8".

This Comparative Resin 8 contained 92% by weight of the styrene component, in which the styrene contents in the H-component and the L-component were 97% by weight and 90% by weight, respectively, and had $\overline{M}_w$=1,050,000, $\overline{M}_n$=25,000 and a glass transition temperature of 54° C.

Preparation of a toner

A comparative toner having an average particle size of 15 microns was obtained in a manner similar to the preparation of a toner in Example 10 except that the above Comparative Resin 8 was used as the binder resin. This comparative toner is designated as "Comparative Sample 8".

EXAMPLE 12

The Resin 10 obtained by the preparation of a binder resin in Example 10 was used as the binder resin. With use of 50 parts of the Resin 10, 50 parts of fine powder of tri-iron tetroxide and 3 parts of carbon black, a magnetic toner of the present invention having an average particle size of 15 microns was obtained by a usual method. This magnetic toner is designated as "Sample 12".

TEST EXAMPLE

With respect to each of the Samples 10 to 12 and the Comparative Samples 5 to 8 obtained by Examples 10 to 12 and Comparative Examples 5 to 8, respectively, the coagulation property, the offset generation temperature, the minimum fixing temperature and the pulverization property were investigated.

With respect to the coagulation property, 50 g of each sample was placed in a watch glass and left to stand for 48 hours in a constant temperature chamber held at a temperature of 60° C., whereupon the presence or absence of the coagulation was determined.

With respect to the Samples 10 and 11 and the Comparative Samples 5 to 8, the offset generation temperature was determined in such a manner that 5 parts of each sample was mixed with 95 parts of an iron carrier to prepare a total of six different kinds of developing agents; with use of each developing agent, a toner image was formed on a transfer paper by means of an electrophotographic copying machine "U-Bix V"(manufactured by Konishiroku Photo Ind. Co. Ltd.); the toner image was fixed by a heat roller fixing device set for a fixing temperature; thereafter, a white transfer paper was fed to the fixing device operated under the same condition to see whether or not a toner stain appeared on the transfer paper, thereby determining whether or not the offset phenomenon occurred; and this operation was repeated at various fixing temperatures of the fixing device to determine the minimum temperature at which the offset phenomenon occurred. The surface layer of the heat roller of the fixing device was composed of Teflon.

With respect to the Sample 12, the minimum temperature for the generation of the offset phenomenon was determined in a manner similar to the above except that the toner image was formed by means of an electrophotographic copying machine "U-Bix T"(manufactured by Konishiroku Photo Ind. Co., Ltd.).

The determination of the minimum fixing temperature was carried out in such a manner that a toner image was formed in the same manner as in the above determination of the offset generation temperature and the operation for fixing the toner was repeated at various temperatures of the fixing device to determine the minimum temperature at which adequate fixing was accomplished.

The determination of the pulverization property was carried out in such a manner that aggregates of each of the Samples and the Comparative Samples prior to the pulverization in the preparation, were roughly pulverized, the roughly pulverized material was then finely pulverized by a jet pulverizer under the conditions of a pulverizing pressure of 6.0 kg/cm$^2$ and a feeding rate of 100 g/min, and an average particle size of the obtained product was measured.

The results thereby obtained are shown in Table 3 together with the temperature ranges within which the fixing is operable. This fixing operable temperature range is a temperature range within which adequate fixing can be done without giving rise to the offset phenomenon, and thus represents a difference between the offset generation temperature and the minimum fixing temperature.

TABLE 3

| Coagulation | Sample 10 Negative | Sample 11 Negative | Comparative Sample 5 Positive | Comparative Sample 6 Negative | Comparative Sample 7 Positive | Comparative Sample 8 Positive | Sample 12 Negative |
|---|---|---|---|---|---|---|---|
| Offset generation temperatures (°C.) | 225 | 220 | 210 | 225 | 205 | 220 | 230 |
| Minimum fixing temperatures (°C.) | 135 | 130 | 130 | 160 | 120 | 155 | 145 |
| Fixing operable temperature ranges (degrees) | 90 | 90 | 80 | 65 | 85 | 65 | 85 |
| Pulverization property (microns) | 14 | 13 | 20 | 15 | 50 | 30 | 12 |

From the above results, it will be understood that each of the Samples 10 to 12 is superior in the noncoagulation property, the non-offset property, the fixability, the fixing operable temperature range and the pulverization property. The Comparative Samples 5 and the Comparative Sample 7 have drawbacks that they are likely to form coagulation and have an inferior pulverization property. The Comparative Sample 6 has poor fixability although it has a good non-coagulation property. The Comparative Sample 8 is inferior in the non-coagulation property, the fixability and the pulverization property.

We claim:

1. A toner for developing electrostatic images which comprises a binder resin comprising at least 60% by weight of a styrene-butadiene copolymer, in which said copolymer contains a component having a molecular weight of at least 100,000 in an amount of at least 20% by weight of the entire binder resin provided that a component having a molecular weight of more than 500,000 is not more than 15% by weight of the entire resin and the ration ($\overline{M}_w/\overline{M}_n$) of the weight average molecular weight to the number average molecular weight of said styrene-butadiene copolymer is at least 20.

2. The toner as claimed in claim 1, in which the binder resin contains a low molecular weight component having a molecular weight of not more than 50,000.

3. The toner as claimed in claim 1, in which the styrene-butadiene copolymer contains from 70 to 98% by weight of a styrene component.

4. The toner as claimed in claim 1, in which the weight average molecular weight of the styrene-butadiene copolymer is from 200,000 to 1,500,000.

5. The toner as claimed in claim 1, in which the weight average molecular weight of the styrene-butadiene copolymer is from 200,000 to 1,500,000.

6. The toner as claimed in claim 1, in which the styrene-butadiene copolymer (a) comprises a low molecular weight copolymer component and a high molecular weight copolymer component, the bound styrene content in the low molecular weight copolymer component being greater than that in the high molecular weight copolymer component; and (b) contains from 70 to 98% by weight of the styrene component.

7. The toner as claimed in claim 6, in which the ratio ($\overline{M}_w/\overline{M}_n$) of the weight average molecular weight to the number average molecular weight of the styrene-butadiene copolymer is at least 3.5.

8. The toner as claimed in claim 6 in which the weight average molecular weight of the low molecular weight copolymer component is not more than 500,000 and the weight average molecular weight of the high molecular weight copolymer component is at least 800,000.

9. The toner as claimed in claim 6 and 8, in which the bound styrene content in the low molecular weight copolymer component of the styrene-butadiene copolymer is from 85 to 98% by weight, and the bound styrene content in the high molecular weight copolymer component is from 70 to 98% by weight.

10. The toner as claimed in claim 4, in which said ratio ($\overline{M}_w/\overline{M}_n$) is 40 to 90.

* * * * *